United States Patent [19]

Boda

[11] Patent Number: 4,482,331

[45] Date of Patent: Nov. 13, 1984

[54] DAMPENER FOR VANE STEERING OF MARINE DRIVE

[75] Inventor: James Boda, Winneconne, Wis.

[73] Assignee: Brunswick Corporation, Skokie, Ill.

[21] Appl. No.: 321,758

[22] Filed: Nov. 16, 1981

[51] Int. Cl.[3] ..... B63H 25/06

[52] U.S. Cl. ..... 440/51; 440/61; 440/62; 114/144 R

[58] Field of Search ..... 440/51, 53, 55, 61, 440/62, 63; 114/144 R; 244/75 A; 188/317

[56] References Cited

U.S. PATENT DOCUMENTS

| | | | |
|---|---|---|---|
| 1,584,884 | 5/1926 | Merrick | 188/317 |
| 3,863,592 | 2/1975 | Borst | 188/317 |
| 3,943,878 | 3/1976 | Kirkwood et al. | 440/51 |
| 4,352,666 | 11/1982 | McGowan | 440/53 |
| 4,362,515 | 12/1982 | Ginnow | 440/62 |

FOREIGN PATENT DOCUMENTS

| | | | |
|---|---|---|---|
| 321851 | 10/1929 | United Kingdom | 244/75 A |
| 711953 | 7/1954 | United Kingdom | 244/75 A |

OTHER PUBLICATIONS

Nippon Cable Systems, Inc., Hi-Lex II, Jul., 1976.

*Primary Examiner*—Trygve M. Blix
*Assistant Examiner*—Thomas J. Brahan
*Attorney, Agent, or Firm*—Andrus, Sceales, Starke & Sawall

[57] ABSTRACT

A steering system (15) for a boat (16) includes a dampening apparatus (130) providing a fluid filled piston assembly (131) having a cylindrically shaped fluid containing housing (132) pivotally connected to a drive unit (18) and a piston head (137) and attached piston rod (137) pivotally connected to a vane control member (27) attached to a control vane (22). The piston head (137) provides a metering orifice (140) to control the flow of fluid between spaced fluid containing chambers (141, 142) to restrain rapid rotation of the vane (22) while within the slip stream (34) of the steerable drive (18) to control the rotative position of the steerable drive (18).

1 Claim, 14 Drawing Figures

DAMPENER FOR VANE STEERING OF MARINE DRIVE

CROSS REFERENCE TO RELATED APPLICATION

A portion of the apparatus and methods disclosed in this application are disclosed and/or claimed in the following concurrently filed applications:

Ser. No. 06/322,006, filed Nov. 16, 1981 in the name of James Boda and entitled "Articulated Cable For Vane Steering Of Marine Drive" now abandoned; and Ser. No. 06/321,752, filed Nov. 16, 1981 in the name of James Boda and entitled "Connector For Vane Steering Of Marine Drive"; now U.S. Pat. No. 4,416,636.

TECHNICAL FIELD

The invention relates to a dampener for the vane steering of a marine drive.

BACKGROUND ART

A tiller or steering arm has been frequently used to control the direction of a steerable marine drive having a pendant drive unit which is selectively rotatable about a substantially vertical axis. Such drive unit generally provides a selectively driven propeller to provide a steering thrust to the boat. In addition, some constructions have employed a pivotal vane having a surface within the slip stream of the propeller to apply torque upon the vane surface and provide a turning movement to the inter-connected drive unit.

One or more cables have generally been used to connect a steering control or helm to the drive unit to control the rotation of the pivotal vane and/or the steering arm. Such cables may have cores or internal rods which move either axially or circumferentially to control the pivotal position of the vane and/or steering arm, such as in the Broadwell U.S. Pat. No. 3,149,605; the Kirkwood U.S. Pat. No. 3,943,878; the U.S. application Ser. No. 06/106,833 entitled "Vane Steering System For Marine Drives" filed on Dec. 26, 1979 by Edward John Morgan and Neil Allan Rohan, and assigned to a common assignee herewith; and the U.S. application Ser. No. 06/139,001 entitled "Marine Drive Vane Steering System" filed on Apr. 10, 1981 by Russell F. Ginnow, and assigned to a common assignee herewith.

One system provides a rigid rotatable rod to interconnect the steering control to the rotatable vane, such as in the Conover U.S. Pat. No. 2,993,464.

DISCLOSURE OF INVENTION

A steering system for a boat includes a dampening apparatus which operatively connects a pivotal vane to a pivotal steerable drive to restrain rapid rotation of the vane while within the slip stream of the steerable drive to control the rotative position of the steerable drive.

A fluid filled piston assembly operatively connects the rotatable vane to the steerable drive and includes a piston head having a metering orifice to control the flow of fluid between spaced fluid containing chambers to restrain rapid rotation of the vane.

BEST MODE FOR CARRYING OUT THE INVENTION

Figure 1:
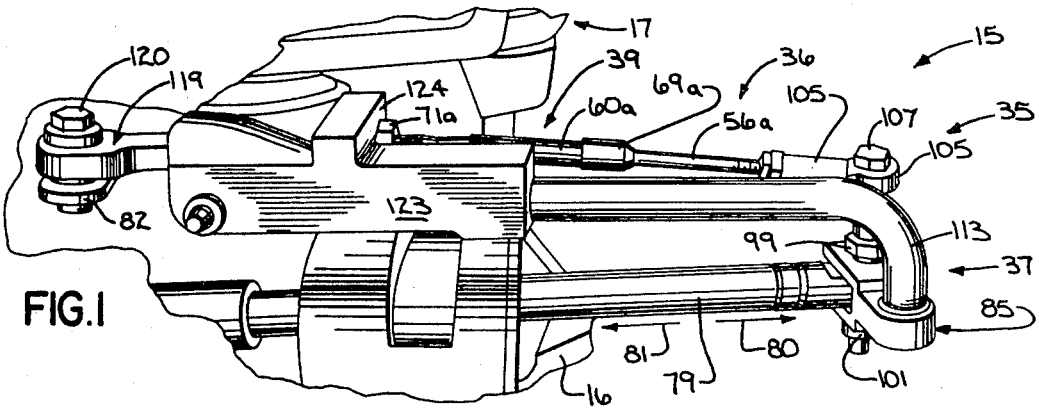
FIG. 1 is a perspective view of a portion of a steering control connecting a push-pull input cable to a steering arm and a rotatable vane.
Figure 2:
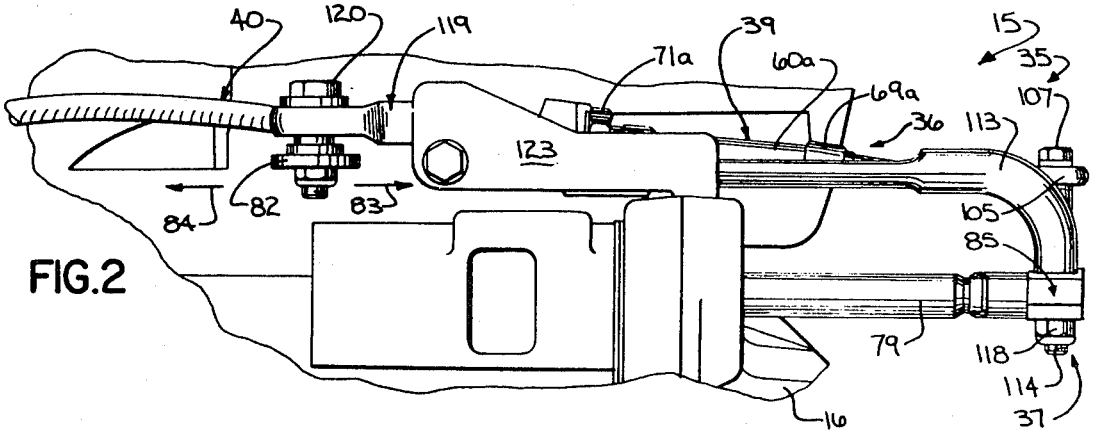
FIG. 2 is a side elevational view of the steering control of FIG. 1.

A steering system 15 is connected to a boat 16 having a steerable marine drive 17 including a pendant drive unit 18 which is selectively rotatable about a substantially vertical axis 18.

A propeller 20 is mounted on the lower portion of the drive unit 18 and is therefore rotatable about the axis 19 to selectively provide a steering thrust in any one of a number of circumferentially spaced directions to effect the steering of the boat 16.

The lower drive unit 18 includes an anti-cavitation plate 21 located above the propeller 20 which retains a pivotal vane 22. An opening 23 within the anti-cavitation plate 21 contains a sleeve 24 having a central opening to retain a pivotal pin 25 attached to vane 22. An upper portion 26 of pin 25 is secured to a vane control member 27 through a nut 28 and washer 29. The vane control member 27 includes a pair of oppositely spaced arms 30 and 31.

The rotatable vane 22 includes a pair of oppositely spaced control surfaces 32 and 33 which are located rearwardly of propeller 20. The vane 22 is selectively rotatable to be subjected to a slip stream, as diagramatically illustrated at 34, which is produced by the thrust of the rotating propeller 20.

In operation, the force of the slip stream 34 upon either of the vane surfaces 32 or 33 imparts a force against vane 22 which includes a force vector normal to the slip stream 34 to provide a turning force to the pendant drive unit 18. A selective controlled rotation of vane 22 varies the area of surfaces 32 and 33 that is subjected to the slip stream 34 thereby varying the turning force applied to the pendant drive unit 18. The rotation of vane 22 to subject surface 32 to the slip stream 34 will turn the drive unit 18 in a first direction while subjecting the surface area 33 to the slip stream 34 will turn the drive unit 18 in a second direction. The selective rotative positioning of vane 22 thus controls the rotative positioning of drive unit 18 to selectively control the steering thrust provided by propeller 20.

Figure 14:
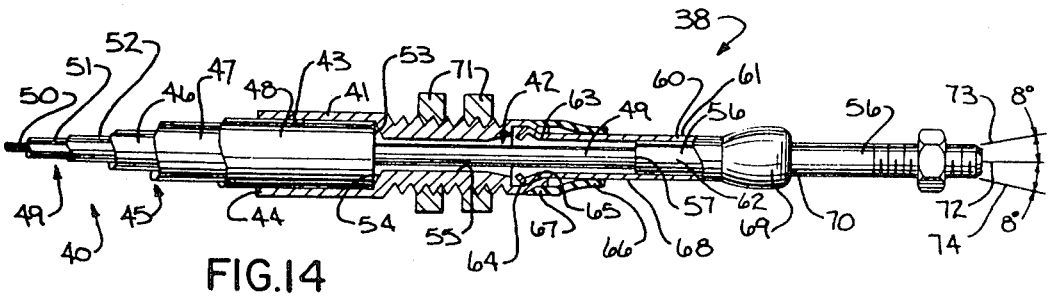
FIG. 14 illustrates the articulated cable of FIGS. 9–13 with parts broken away.

A control assembly 35 includes a cable 36 which connects the arm 31 of the vane control member 27 to a lost motion assembly 37. The cable 36 includes a pair of articulated cable sections 38 and 39 inter-connected by a push-pull cable section 40. The articulated cable section 38 is constructed and operates in a substantially identical manner as the articulated cable section 39. The articulated cable section 38 is illustrated in FIG. 14 and will be described in detail and identical components of the articulated cable section 39 will be identified by identical numbers primed and further description thereof is unnecessary.

The articulated cable section 38 includes an annular housing 41 having an axial opening 42. A first opening portion 43 is located at a first end 44 and securely retains an outer casing 45 provided by the push-pull cable 40. The outer fixed casing 45 includes a cylindrically shaped conduit 46 surrounded by a protective winding 47 and encased by a protective coating 48, the later being secured within opening 43 of housing 41. An inner slidably movable core 49 of cable 40 includes an internal core 50 surrounded by a protective winding 51 and an outer coating 52.

In operation, the inner core 49 slidably moves in an axial direction within the fixed conduit 46 provided by the outer casing 45 to provide a turning command to the pivotal vane 22. An axial end 53 of the outer casing 45 engages an annular abutment 54 which connects the first opening portion 43 with a second opening portion 55 having a smaller cross-sectional diameter than that provided by the first section 43. The inner core 49 axially extends beyond the end 53 of outer casing 45 and passes through the second opening portion 55 to securely engage an operating rod 56 by a weld or other suitable connection at a junction 57. With such connection, the rod 56 axially moves in unison with the inner core 49. The rod, in turn, is connected to the arm 31 of the control member 27 through a connecting link 58 and a bolt and nut assembly 59 to provide an operative pivotal connection between the operating rod 56 and the rotatable arm 31 of the control member 27.

A cylindrical sleeve 60 surrounds the junction 57 formed by rod 56 and inner core 49 and provides a first end portion 61 which is connected to surround a first portion 62 of rod 56. The sleeve 60 provides a second end portion 63 which is axially spaced from the end portion 61 and is radially spaced from the inner core 49. The end portion 63 of sleeve 60 includes an annular ridge 64 which is seated within an annular groove 65 provided by the housing 41. A first annular seal 66 interconnects an outer cylindrical surface 67 of housing 41 and an outer cylindrical surface 68 of sleeve 60. A second seal 69 inter-connects the outer cylindrical surface 68 of sleeve 60 with an outer cylindrical surface 70 of rod 56. The seals 66 and 69 are preferably formed of a flexible type material to provide a seal to prevent contaminants from entering the second opening portion 55 while still permitting radial movement of the rod 56 with respect to the housing 41. The casing 41 is fixedly connected to the drive unit 18 by a pair of locking nuts 71 to securely retain the cable 40 and particularly the outer casing portion 45 in fixed axial alignment along an axis 72.

Figure 11:
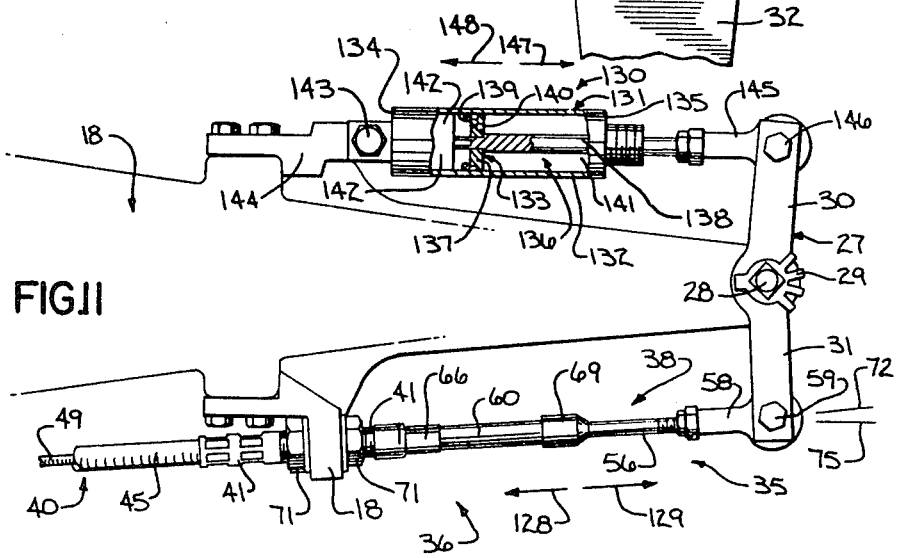
FIG. 11 is a plan view with parts broken away of a portion of a drive unit of FIG. 9.
Figure 12:
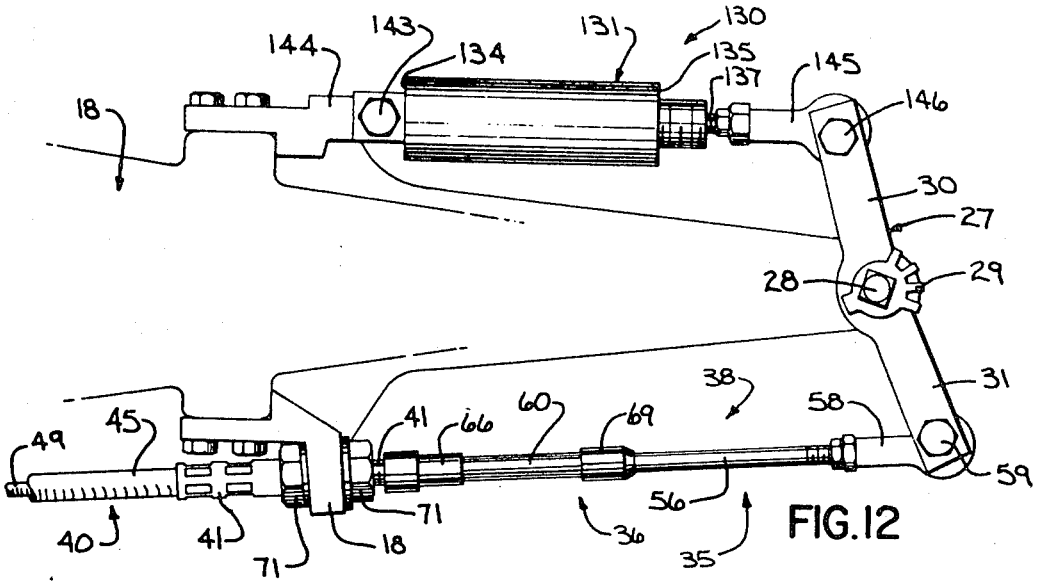
FIG. 12 shows the plan view of FIG. 11 but with the vane rotated to a second rotative position to provide a turning movement.
Figure 13:
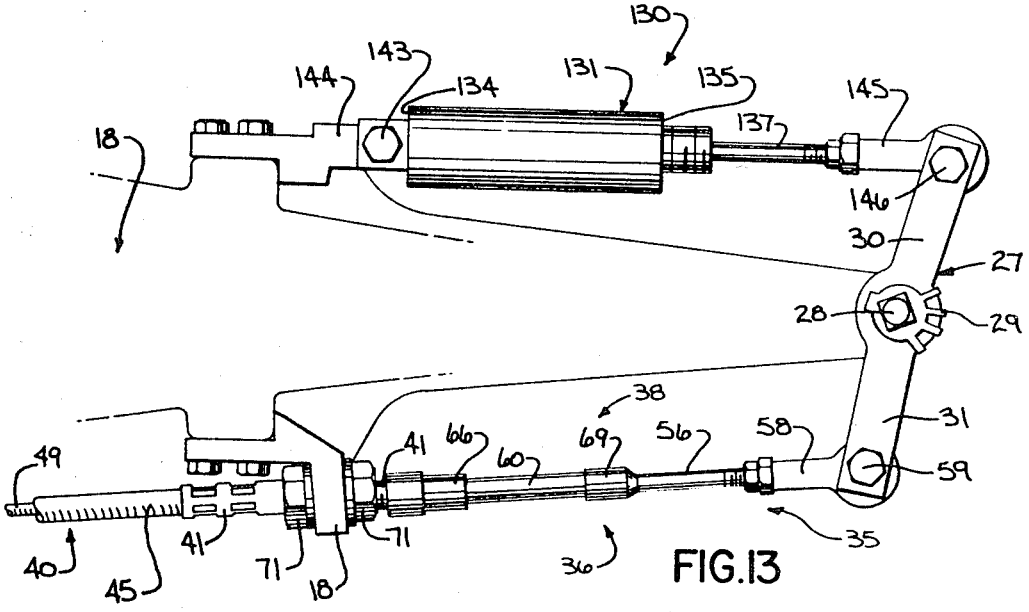
FIG. 13 shows the plan view of FIG. 11 but with the vane rotated to a third rotative position to provide another turning movement.

In operation, the articulated connector section 38 functions to permit a substantial radial flexure of the rod 56 with respect to the cable 40 while still retaining precise operating control through the unitary movement of the inner core 49 and inter-connected rod 56. As an illustrative example, the rod 56 could be moved upwardly so that its axis is co-extensive with the reference line 73 or could be move downwardly so that its axis is co-extensive with the reference line 74. The reference lines 73 and 74 thus fall within a cone within which rod 56 is permitted to radially move. The cylindrical spacing between the sleeve 60 and the inner core 49 and the movable connection between the annular ridge 64 and the annular groove 65 provided by housing 41 permits the substantial radial flexure of rod 56 with respect to the inter-connected inner core 49. Such relative flexure of rod 56 with respect to the inner core 49 permits responsive control by the axially slidable inner core 49 and inter-connected rod 56 to selectively rotate the control member 27. For example, FIG. 11 illustrates a rotative position of the control member 27 wherein an axis 75 of rod 56 is spaced from the axis 72 of the housing 41 and inter-connected end portion of cable 40. The rotative positioning of control member 27 in FIGS. 12 and 13 show substantial alignment between the axis 72 and 73. The articulated cable section 38 permits radial flexure between two control members that are slidable axially to control the rotation of the vane to permit precise operating control through a reliable inter-connection.

The articulated connector section 38 permits pivoting of the cable 36 to permit relative movement between the first cable attachment, such as provided at the connection of the housing 41 to the drive unit 18 through the locking nuts 71, and the second cable attachment, such as provided at the connection of the link 58 to the arm 31 through the bolt and nut assembly 59. Such articulation permits the cable 36 to accurately track the steering and tilting movements of the drive unit 18 to provide responsive control.

The coupling assembly 37 inter-connects the articulated cable section 39 with an axially movable input member 79. The input control member 79 may comprise a ram or cable which moves in a first direction 80 to command rotation of the drive unit 18 in a first direction and axially moves in an opposite direction 81 to command rotation of the drive unit 18 in a second direction. The axially movable member 79 may be connected to a helm or steering station through one or more inter-connected cables which could supply hydraulic operating fluid to operate the control member 79 or could provide a movable core such as a push-pull cable or a rotary core member to move the input control member 79 in either of the two controlled directions 80 and 81. In any event, the input control member 79 is generally connected in close proximity to a tiller or steering arm 82 which is operatively connected to rotate in unison with the drive unit 18. For example, the steering member 82 may be moved in a first direction 83 to provide direct rotative control of the drive unit 18 in one direction while the steering arm 82 may be moved in a second direction 84 to directly rotate the drive unit 18 in an opposite direction.

A rotatable link 85 includes a first link portion 86 providing a cavity or notch 87 to receive an end portion 88 of the input member 79. The link portion 86 includes a top wall 89 spaced from a bottom wall 90 to form the cavity 87. A first abutment 91 joins the top wall 89 to the bottom wall 90 to form a side wall surface 92 which is permitted to selectively engage the portion 88 of the input control member 79 under certain operating sequences. A second side wall 93 is spaced from side wall 92 and joins the top wall 89 to the bottom wall 90 to provide a second surface to selectively engage the portion 88 of the input member 79 under certain operating sequences. A pair of aligned openings 94 and 95 are formed in the top and bottom walls 89 and 90, respectively, and are aligned with an opening 96 formed in portion 88 of the input control member 79 to retain a control pin 97 therein.

The pin 97 pivotally joins the input control member 79 to the rotatable link 85. The pin 97 includes an upper portion 98 which extends upwardly beyond the opening 94 in top wall 89 of link 85. An annular ring or nut 99 is secured to the pin portion 98 and engages a top surface 100 of the top wall 89 to maintain the pin 97 within the aligned openings 94, 95 and 95 while a second annular ring or nut 101 is secured to a lower portion 102 of pin 97 to prevent the removal of pin 97 from the aligned openings. The upper portion 98 of pin 97 provides a threaded portion 103 of a reduced diameter to form an abutment 104. A connecting link 105 provides an opening 106 which surrounds the threaded portion 103 and is secured to the abutment 104 by an appropriate lock nut and washer assembly 107. The connector 105 is connected to the rod **56*a* of the articulated cable section 39 and is permitted to pivot about pin 97. In such manner, the aligned openings 94, 95 and 96 form a pivotal connection through the retaining pin 97 to permit pivotal movement between the input member 79 and the rotatable link 85 and between the rotatable link 85 and the articulated cable section 39**.

A second section 109 of the rotatable link 85 provides an opening 110 having an axis 111 which is spaced substantially in parallel with an axis 112 for the aligned openings 94 and 95. A control rod or pin 113 is rotatably connected to the second section 109 of the rotatable link 85 and includes a threaded rod section 114 located within the opening 110. The rod 113 provides an abutment 115 which engages a top surface 116 of link section 109 through an inter-connected washer 117 while the rod 113 is retained within opening 110 by a locking nut 118. A pivotal connection is thereby formed between the pin or rod 113 and the rotatable link 85.

The connecting rod 113 provides a second end 119 which is pivotally connected through a bolt, nut and washer assembly 120 to the steering arm 82. Movement of the connecting rod 113 in a first direction 121 will cause the steering arm 82 to move in direction 84 while movement of the coupling rod 113 in an opposite direction 122 will cause the steering arm 82 to travel in direction 83.

The connecting rod 113 further includes a mounting assembly 123 which includes an extension 124 having an opening 125 to fixedly retain the casing **41*a* of the articulated cable section 39 through the pair of coupling lock nuts 71*a*. With such connection, the connecting rod 113 is substantially spaced longitudinally adjacent to the articulated cable section 39 and to the input member 79**.

Figure 3:
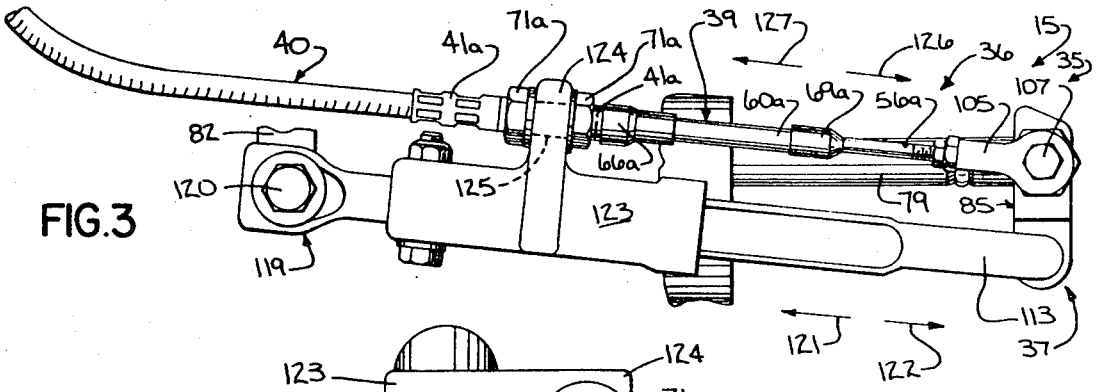
FIG. 3 is a plan view of the steering control of FIG. 1.
Figure 4:
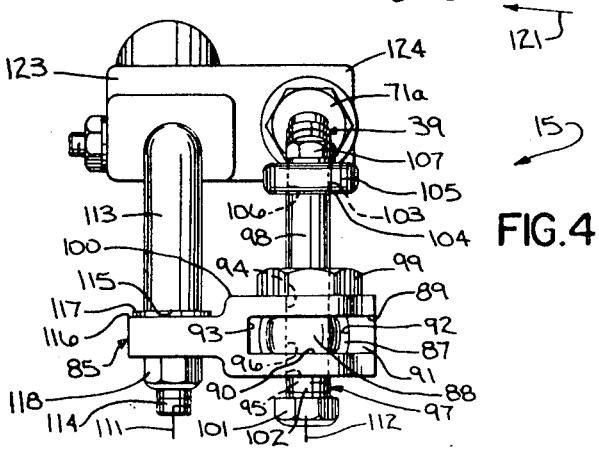
FIG. 4 is an end view of the steering control of FIG. 1.
Figure 5:
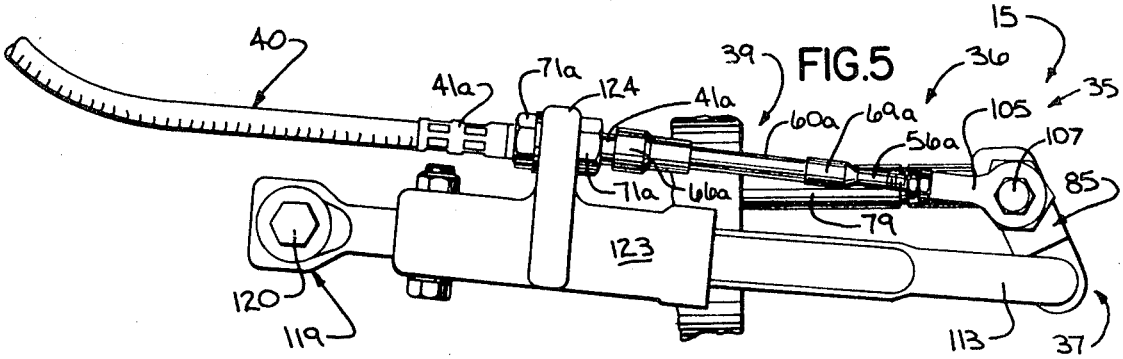
FIG. 5 is a plan view of the steering control of FIG. 1 and illustrates the connector rotated to engage a first stop.
Figure 7:
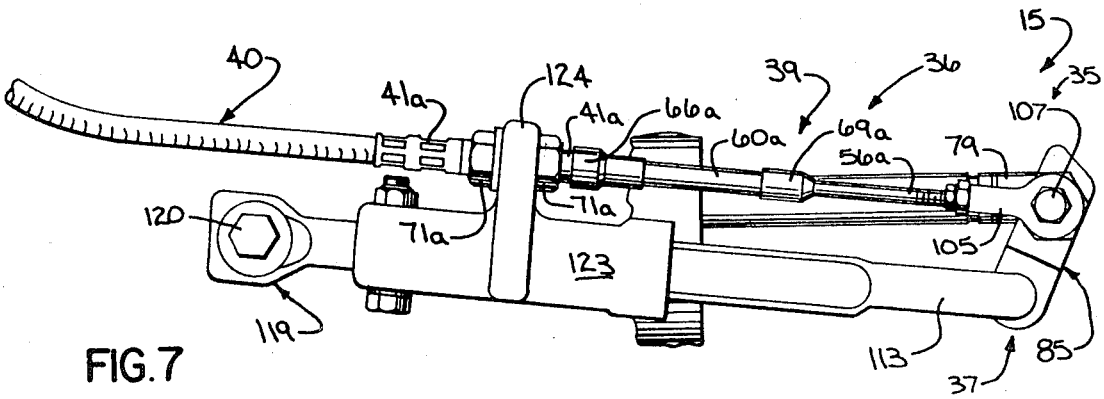
FIG. 7 is a plan view of the steering control of FIG. 1 and illustrates the connector rotated to engage a second stop.

In operation, the rotatable link 85 responds to the axially movable input member 79 to control the axial movement of the articulated cable section 39 and the connecting rod 113. FIGS. 3 and 4 illustrate the end portion 88 of input member 79 being spaced from the side walls 92 and 93. Movement of the input member 79 in either direction 80 or 81 between the side walls 92 and 93 provides a corresponding movement of rod **56*a* of the articulated cable section 39 in the directions 126 and 127, respectively. The movement of rod 56*a* in directions 126 or 127, in turn, axially moves the interconnected inner cable 49 and rod 56 in directions 128 or 129, respectively. For example, movement of the input member 79 in direction 80 moves control rod 56*a* in direction 126 to correspondingly move control rod 56 and inner core 49 in direction 128. The arm 31 of the vane control member 30 is thereby commanded to rotate in a clockwise direction, such as illustrated in FIG. 13. In like manner, movement of the control member 79 in direction 81 causes the control rod 56*a* to correspondingly move in direction 127 thereby causing the control rod 56 and interconnected inner core 49 to move in direction 129 to rotate arm 31 of the vane control member 30 in a counter-clockwise direction, such as illustrated in FIG. 12**.

The input member 79 is axially positioned to provide direct control over the selective rotation of vane 22 as long as member 79 operates between the side walls 92 and 93 of the rotatable link 85 without imparting any rotative force to the steering arm 82.

Figure 6:
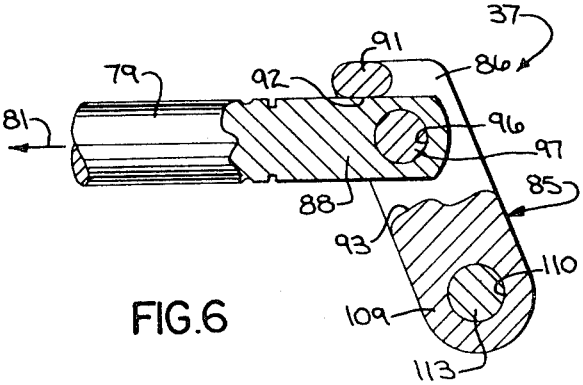
FIG. 6 is a broken away view of the connector of FIG. 5.
Figure 9:
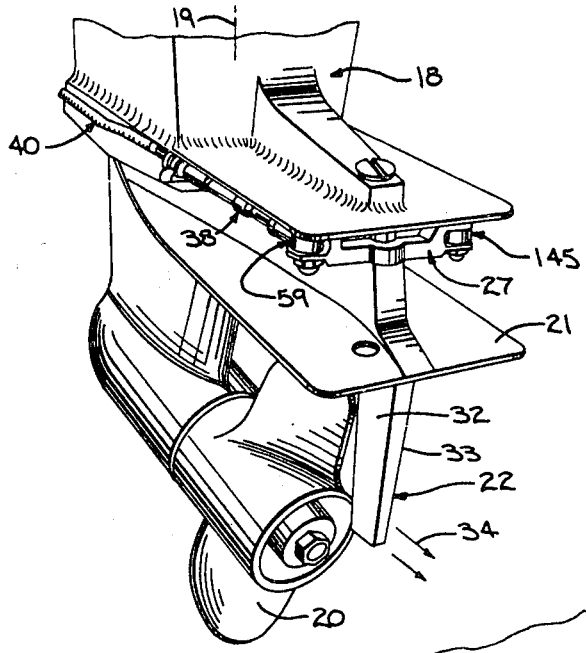
FIG. 9 is a perspective view of a pendant drive unit having a pivotal vane located within the slip stream of a propeller.
Figure 10:
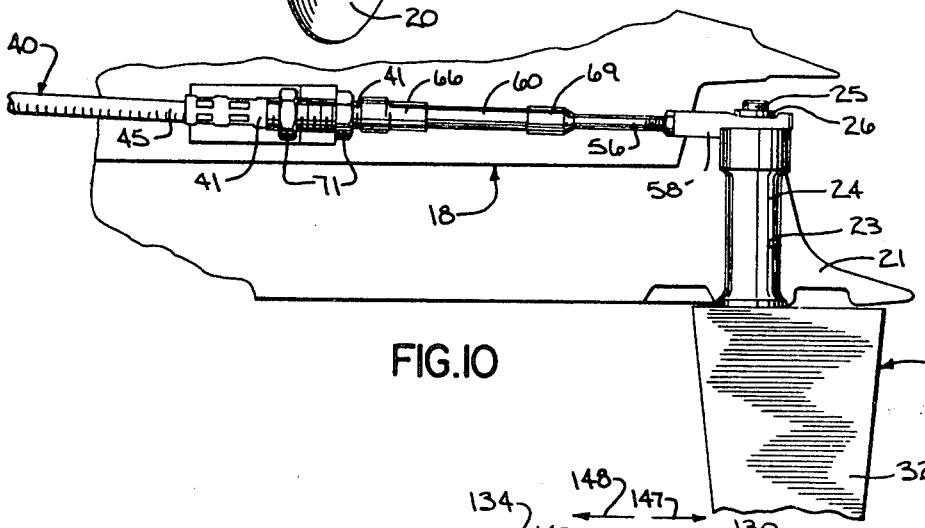
FIG. 10 is a side elevational view of a portion of the pendant drive unit of FIG. 9.

A substantial axial movement of the control member 79 may, in certain instances, cause the input member 79 to engage one of the side walls 92 and 93 of the rotatable link 85. As illustrated in FIG. 6, movement of the control member 79 in direction 81 may cause the portion 88 to engage the side wall 92 of the rotatable link 85. Further movement of input member 79 in direction 81 establishes a rigid connection between the link 85 and the connecting rod 113 to provide movement in direction 121 to correspondingly move the steering arm 82 in direction 84. Thus by the engagement of the input member 79 against the side wall or stop 92, the movement of the input member 79 in direction 81 directly causes movement of the steering arm 82 in direction 84 to directly control the direction of thrust of the drive unit 18 irrespective of the positioning of vane 22.

Figure 8:
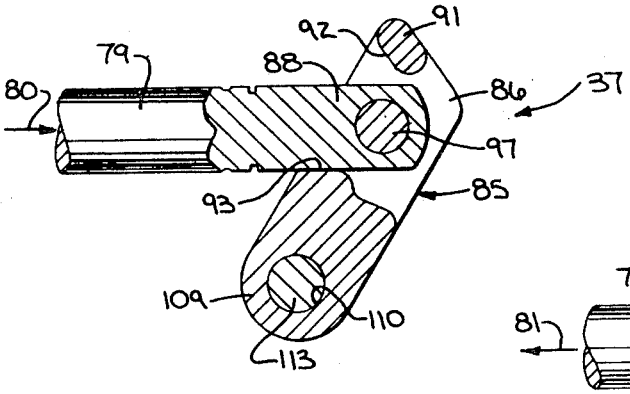
FIG. 8 is a broken away view of the connector of FIG. 7.

In another sequence of operation, movement of the input member 79 in direction 80 may cause the portion 88 to engage the side wall or stop 93, such as illustrated in FIG. 8. With the engagement of input member 79 with stop 93, a direct operative connection is formed to move connector 113 in direction 122 to correspondingly rotate the steering arm 82 in direction 83. In such manner, the movement of input member 79 in direction 80 to engage stop 93 rotates the steering arm 82 in direction 83 to provide direct turning control of the drive unit 18 irrespective of the operating position of vane 22.

It has been found that under many operating conditions, a complete steering control of the drive unit 18 is accomplished through the selective control of the rotative position of vane 22 through the pivotal connection between the pivotal link 85 and the inter-connected cable assembly 36 without providing any operative steering force to the steering arm 82. If severe turning control is required or if the boat is operating at a very low speed, direct turning movement of the drive unit 18 may be provided through the pivotal connection between the pivotal link 85 and the coupling rod 113. As long as the input member 79 operates between the side walls or stops 92 and 93, direct pivotal control is provided to the rotatable vane 22 without imparting any steering force to the steering arm 82. Whenever the input member 79 engages one of the steps or side walls 92 or 93, a direct turning control is provided to the steering arm 82 irrespective of the rotative position of vane 22.

A dampener 130 inter-connects the arm 30 of the vane control member 27 to the drive unit 18. As illustrated in FIG. 11, the dampener 130 includes a fluid filled piston assembly 131 having an outer cylindrical housing 132 retaining a reciprocating piston 133. The cylinder 132 has oppositely spaced sealed ends 134 and 135 to form an internal chamber 136. The piston 133 includes a piston head 137 and attached piston rod 138 which passes through an opening (not shown) within the end 135 through an appropriate seal to maintain a fluid tight operating chamber 136. The piston head 137 slidably engages the inner cylindrical wall of the housing 132 and includes an annular seal 139 to form a fluid tight connection therewith. A metering orifice 140 is formed in piston head 137 and permits the metered passage of fluid between a first chamber portion 141 and a second chamber portion 142 located on opposite sides of the piston head 137.

The piston assembly 131 is connected to the drive unit 18 through a pivotal connection 143, such as a bolt and nut assembly or the like, and link 144 to permit pivotal movement of the piston assembly 131 with respect to the drive unit 18. The piston rod 138 is connected through a connecting link 145 to the arm 30 of the vane control member 27 through a pivotal connection 146, such as provided by a bolt and nut assembly or the like. Each of the arms 30 and 31 may be of a different length to reduce lost motion at the lost motion assembly 37 and to obtain more lead angle of the vane 22.

Movement of the rod 56 in directions 128 or 129 causes the piston 133 to move in directions 147 or 148, respectively. For example, movement of rod 56 in direction 128 rotates the vane control member 27 in a clockwise direction to move piston 133 in direction 147. Likewise, movement of rod 56 in direction 129 causes the vane control member 27 to rotate in a counterclockwise direction to move the piston 133 in direction 148. The metering of fluid, such as water, oil or any other convenient fluid, provided by orifice 140 restrains rapid rotation of the vane control member 27 and interconnected vane 22 to provide a smooth rotating control over the vane 22. The orifice 140 is provided with a predetermined cross-sectional diameter to permit fluid flow between chamber portions 141 and 142 to permit responsive precise operating control over the vane control arm 27 while substantially eliminating any unwanted oscillations or "over shooting" of the desired command position for rotary vane 22.

The utilization of the dampener 130 is particularly desirable for use in conjunction with a single control cable 36 by substantially reducing the likelihood of uncontrolled oscillation or unwanted movement of the vane control member 27 and inter-connected rotary vane 22 if the control cable 36 should be disconnected during an operating sequence.

What is claimed is:

1. A steering system for a boat having a steerable marine drive including a pendant drive unit selectively rotatable about a substantially vertical axis and having a selectively driven propeller to provide steering thrust to said boat and a pivotal vane selectively providing a portion of a surface within the slip stream of said propeller to apply a torque upon said vane surface and provide a turning movement to said drive unit and a vane control arm connected to operatively control the rotation of said vane surface, a selectively operable input member generally movable in a first direction to command rotation of said drive unit in a first direction and generally movable in a second direction to a command rotation of said drive unit in a second direction, and a push-pull cable assembly connecting said input member to said vane control arm including a first cable portion including an outer casing fixedly connected to said marine drive and an inner slidably movable core having first and second spaced ends axially movable in unison and a second cable portion including a housing having an axial opening providing a first opening portion having a first diameter to fixedly retain said outer casing and an axially spaced second opening portion having a second diameter smaller than said first diameter to slidably retain said inner core therein and a rod having a first end fixedly connected to said first end of said inner core to axially move in unison therewith and a second end connected through a pivotal connection to said vane control arm and a cylindrical sleeve surrounding the junction of said rod and said inner core including a first end portion connected to surround said and an axially spaced second end portion radially spaced from said inner core and providing an annular ridge retained within an annular groove provided by said housing within said second opening portion to permit substantial radial flexture of said rod and cylindrical sleeve with respect to said housing and first cable portion and a third cable portion including a housing having an axial opening providing a first opening portion having a first diameter to fixedly retain said outer casing and an axially spaced second opening portion having a second diameter smaller than said first diameter smaller than said first diameter to slidably retain said inner core therein and a rod having a first end fixedly connected to said second end of said inner core to axially move in unison therewith and a second end pivotally connected to said input member and a cylindrical sleeve surrounding the junction of said rod and said inner core including a first end portion connected to surround said and an axially spaced second end portion radially spaced from said inner core and providing an annular ridge retained within an annular groove provided by said housing within said second opening portion to permit substantial radial flexure of said rod and cylindrical sleeve with respect to said housing and first cable portion to control the rotative position of said steerable marine drive a dampening member operatively connecting said vane to said drive unit to restrain rapid rotation of said vane.

* * * * *

UNITED STATES PATENT AND TRADEMARK OFFICE

CERTIFICATE OF CORRECTION

PATENT NO. : 4,482,331

DATED : 11-13-84

INVENTOR(S) : JAMES BODA

It is certified that error appears in the above-identified patent and that said Letters Patent are hereby corrected as shown below:

| | |
|---|---|
| Abstract, Line 6 | After "piston rod" delete "(137)" and substitute therefor ---(138)--- |
| Col. 2, Line 38 | after "axis" delete "18" and substitute therefor ---19--- |
| Col. 4, Line 26 | after "and" delete "73" and substitute therefor ---75--- |
| Col. 5, Line 19 | after "openings 94, 95 and" delete "95" and substitute therefor ---96--- |
| Col. 6, Line 67 | after "one of the" delete "steps" and substitute therefor ---stops--- |

UNITED STATES PATENT AND TRADEMARK OFFICE

CERTIFICATE OF CORRECTION

PATENT NO. : 4,482,331

DATED : 11-13-84

INVENTOR(S) : JAMES BODA

It is certified that error appears in the above-identified patent and that said Letters Patent are hereby corrected as shown below:

| | |
|---|---|
| Claim 1, Column 8<br>Line 37 | after "radial" delete "flexture" and substitute therefor ---flexure--- |
| Claim 1, Column 8<br>Line 62 | after "marine drive" and before "a dampening" insert a paragraph |
| Claim 1, Column 8<br>Line 65 | the text "to said drive unit to restrain rapid rotation of said vane" should be presented as part of the paragraph immediately above it. |

Signed and Sealed this

*Twenty-seventh* Day of *August 1985*

[SEAL]

*Attest:*

DONALD J. QUIGG

*Attesting Officer* *Acting Commissioner of Patents and Trademarks*